United States Patent [19]

Treybig et al.

[11] Patent Number: 4,740,320

[45] Date of Patent: Apr. 26, 1988

[54] PROCESS FOR PREVENTING CORROSION OF A METAL IN CONTACT WITH A WELL FLUID

[75] Inventors: Duane S. Treybig; Robert G. Martinez, both of Lake Jackson, Tex.

[73] Assignee: The Dow Chemical Company, Midland, Mich.

[21] Appl. No.: 7,315

[22] Filed: Jan. 27, 1987

Related U.S. Application Data

[63] Continuation-in-part of Ser. No. 757,830, Jul. 22, 1985, abandoned.

[51] Int. Cl.[4] ..... C23F 11/14

[52] U.S. Cl. ..... 252/8.555; 252/390; 422/7; 422/12; 544/224; 544/237; 544/242; 544/264; 544/283; 544/336; 544/353; 546/176; 546/329; 548/378

[58] Field of Search ..... 252/8.555, 8.553, 390, 252/8.551; 422/7, 12, 16

[56] References Cited

U.S. PATENT DOCUMENTS

| | | | |
|---|---|---|---|
| 3,025,313 | 3/1962 | Gunderson | 252/8.5 X |
| 3,077,454 | 2/1963 | Monroe et al. | 252/148 |
| 3,932,296 | 1/1976 | Byth | 252/8.555 X |
| 4,294,585 | 10/1981 | Sung | 252/390 X |
| 4,323,689 | 4/1982 | Vogel et al. | 252/390 X |
| 4,446,056 | 5/1984 | Thompson | 252/8.555 X |

*Primary Examiner*—Herbert B. Guynn

[57] ABSTRACT

Novel compositions are prepared by reacting hydrocarbyl substituted nitrogen-containing aromatic heterocyclic compounds such as 2,5-dimethylpyridine or 2,4,6-collidine, an aldehyde such as formaldehyde, or a ketone such as acetone, or mixtures thereof and an amine having a combined total of at least seven carbon, nitrogen, oxygen or sulfur atoms and at least one reactive amine hydrogen atom such as 1-dodecanamine in the presence of a suitable catalyst such as hydrogen chloride. These novel compositions, as well as their free amine forms are useful as oil and gas well corrosion inhibitors.

24 Claims, No Drawings

PROCESS FOR PREVENTING CORROSION OF A METAL IN CONTACT WITH A WELL FLUID

CROSS-REFERENCE TO RELATED APPLICATION

This application is a continuation-in-part of our copending application Ser. No. 757,830 filed July 22, 1985, now abandoned.

BACKGROUND OF THE INVENTION

The present invention pertains to novel compositions prepared by reacting hydrocarbyl substituted nitrogen-containing aromatic heterocyclic compounds, aldehydes or ketones and amines having a combined total of at least seven carbon, nitrogen, oxygen and sulfur atoms and at least one reactive amine hydrogen atom.

During the drilling and servicing of oil and gas wells, the metal tools and equipment associated therewith are susceptible to corrosion. It is therefore highly desirable to have corrosion inhibitors for the protection of these metal tools and equipment. The present invention provides corrosion inhibitors for metals for use at both low and high temperatures. The deeper the wells, the higher the temperature; therefore there is a need for inhibitors suitable for protecting metals at both low and high temperatures.

SUMMARY OF THE INVENTION

One aspect of the present invention concerns new compositions of matter which comprises the reaction product of (A) at least one aromatic heterocyclic material having one or more rings, at least one nitrogen atom located in the heterocyclic ring and at least one substituent group which has at least one reactive hydrogen atom attached to a carbon atom which is attached to a carbon atom in said heterocyclic ring;

(B) at least one aldehyde or ketone or a combination thereof; and (C) (1) at least one monoamine having a combined total of at least seven carbon, nitrogen, oxygen or sulfur atoms and at least one reactive amine hydrogen atom; (2) at least one polyamine; or (3) a combination of (1) and (2).

Another aspect of the present invention concerns a process for preparing a corrosion inhibitor which comprises (A) reacting at a temperature of from about 25° C. to about 250° C., preferably from about 60° C. to about 200° C. for about one to about 24, preferably from about 2 to about 8 hours, (1) the product resulting from mixing or reacting (a) at least one aromatic heterocyclic material having one or more rings, at least one nitrogen atom located in the heterocyclic ring and at least one substituent group which has at least one reactive hydrogen atom attached to a carbon atom which is attached to a carbon atom in the heterocyclic ring; and (b) a catalyst selected from sulfuric acid, glacial acetic acid, hydroxides or alkoxides of alkali or alkaline earth metals or a Lewis acid; with (2) (a) at least one monoamine having a combined total of at least seven carbon, nitrogen, oxygen or sulfur atoms and at least one reactive amine hydrogen atom; (b) at least one polyamine; or (c) a combination of (a) and (b); and (3) at least one aldehyde, ketone or combination thereof; and (B) recovering the resultant corrosion inhibitor.

Another aspect of the present invention pertains to a process for preventing or reducing the corrosion of a metal composition in contact with down hole well fluids, which process comprises contacting the surface of said metal composition with an effective amount of the aforementioned novel compositions in either the salt or complexed form or the free amine form.

DETAILED DESCRIPTION OF THE INVENTION

The compositions of this invention are preferably prepared by reacting an aldehyde or ketone with a mixture of an amine and a hydrocarbyl substituted nitrogen-containing aromatic heterocyclic compound. Preferably, the reaction is carried out in an inert atmosphere or under reduced pressure. The reaction can be carried out neat or in the presence of a solvent. A solvent, particularly water, is preferred. It is also desirable to conduct the reaction in the presence of a catalyst. The preferred catlyst is a hydrohalide. The hydrohalide neutralizes the amine, thereby forming the amine hydrohalide. The quantity of (A) the hydrocarbyl substituted nitrogen-containing aromatic heterocyclic compound, (B) the aldehyde or ketone and (C) the amine, employed should provide a mole ratio of (A):(B):(C) of from about 1:0.25:0.25 to 1:5:5, preferably from about 1:1:1 to about 1:2:2. The reaction of the aldehyde or ketone with a mixture of the amine and a hydrocarbyl substituted nitrogen-containing aromatic heterocyclic compound is carried out at a temperature between about 25° C. to about 250° C., preferably from 60° to 200° C. for a time sufficient to complete the reaction, usually from about 1 to about 24 hours (3600–86,400 s), especially from about 2 hours to about 8 hours (7200–28,800 s). The aldehyde or ketone usually is added to a refluxing (100°–125° C.) aqueous solution of the amine and hydrocarbyl substituted nitrogen-containing aromatic heterocyclic compound at a slow rate in the course of 1–10 hours (3600–36,000 s), preferably 1–3 hours (3600–10,800 s). Solvent and reactants can be removed by distillation, sublimation or solvent extraction. The inhibitor in the acid form (formed when employing an acid as a catalyst) can be neutralized with a base.

Examples of an inert atmosphere in which the reaction can be conducted includes nitrogen, helium, neon, xenon, argon mixtures thereof and the like.

Other suitable solvents besides water, include, any solvents in which the reactants and products are soluble such as alcohols, acids, amides, ethers and hydrocarbons. Particularly suitable solvents include, for example, ethanol, methanol, isopropanol, butanol, ethanediol, acetic acid, dioxane, tetrahydrofuran, dimethylformamide, toluene, xylene, combinations thereof and the like.

Suitable bases for neutralizing the inhibitor in the acid form include sodium hydroxide, other hydroxides of alkali and alkaline earth metals, ammonium hydroxide, ammonia and the like. The inhibitor can be extracted with a solvent from the base during or after neutralization and/or salt formed during the neutralization. Suitable solvents for the extraction include chlorinated solvents, ethers and hydrocarbons and the like. Particularly suitable solvents include chloroform, diethyl ether, tetrahydrofuran, benzene, toluene, xylene, combinations thereof and the like.

Suitable aromatic heterocyclic materials having one or more rings, at least one nitrogen atom located in the ring and at least one substituent group which has at least one reactive hydrogen atom attached to a carbon atom which is attached to the aromatic heterocyclic ring which can be employed herein include, for example, pyrazines, pyridines, pyrazoles, imidazoles, pyridazines, pyrimidines, purines, pteridines, triazines, quinolines, quinazolines, phthalazines and quinoxalines. Particularly suitable such substituent groups include methyl, $-CH(R)_2$ or $-CH_2R$ groups wherein each R is independently a hydrocarbyl group containing from 1 to about 10, preferably from 1 to about 2 carbon atoms.

The hydrocarbyl substituted pyrazines, pyridines, pyrazoles, imidazoles, pyridazines, pyrimidines, purines, pteridines, triazines, quinolines, quinazolines, phthalazines and quinoxalines employed herein are all aromatic compounds. The term aromatic as employed herein means that a compound must have a planar (lacking ring strain) molecule that contains cyclic clouds of delocalized pi ($\pi$) electrons located above and below the plane of the molecule; furthermore, the pi clouds must contain a total of $(4n+2)$ pi electrons. This definition of aromatic is given in ORGANIC CHEMISTRY, 2nd ED., by R. T. Morrison and R. N. Boyd, Allyn and Bacon, Inc. 1970, pp 317-318 which is incorporated herein by reference.

All pyrazines, pyridines, pyrazoles, imidazoles, pyridazines, pyrimidines, purines, pteridines, triazines, quinolines, quinazolines, phthalazines and quinoxalines are not necessarily aromatic compounds. For example, pyrazine hexahydride (piperazine), 5,6-dihydropyrazine, tetrahydropyrimidine and hexahydropyrimidine are not aromatic compounds since they are either nonplanar, do not have a total of $(4n+2)$ pi electrons or have a non-cyclic cloud of pi electrons. As a consequence, pyrazine hexahydride, 5,6-dihydropyrazine, tetrahydropyrimidine and hexahydropyrimidine are not pyrazines and pyrimidines of this invention.

The term heterocycle or heterocyclic as employed herein means that the ring must contain at least one nitrogen atom located in the ring. Although benzene and its substituted derivatives are aromatic, they are not considered aromatics of this invention because they do not contain a nitrogen atom located in their ring. The nitrogen atom located in the ring is essential for activation of the hydrogen atom attached to the carbon atom of the substituent group which is attached to the carbon atom of the heterocyclic aromatic ring. The hydrogen atom attached to a carbon atom of a substituent group where the carbon atom is attached to a benzene ring is unreactive.

The term hydrocarbyl as employed herein means any aliphatic, cycloaliphatic, aromatic, aryl substituted aliphatic or aliphatic substituted aromatic groups.

Suitable aromatic heterocyclic materials include, for example, those represented by the following formulas.

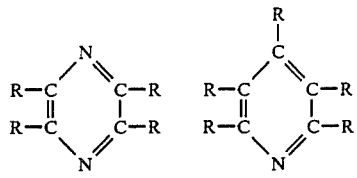

PYRAZINES PYRIDINES

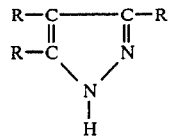

PYRAZOLES

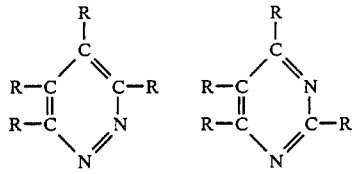

PYRIDAZINES PYRIMIDINES

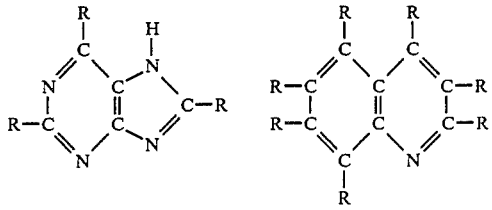

PURINES QUINOLINES

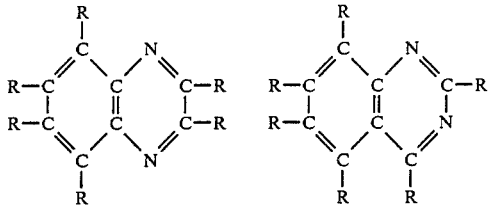

QUINOXALINES QUINAZOLINES

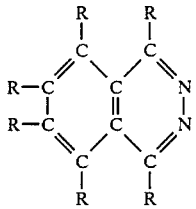

PHTHALAZINES wherein each R is independently hydrogen or a hydrocarbyl group.

Particularly suitable as the aromatic heterocyclic material which can be employed herein include the pyrazines such as, for example, 2-methylpyrazine, 2,3-dimethylpyrazine, 2,5-dimethylpyrazine, 2,6-dimethylpyrazine, 2,3,5-trimethylpyrazine, 2,3,5,6-tetramethylpyrazine, 2-ethylpyrazine, 2-ethyl-3-methylpyrazine, 2-ethyl-5-methylpyrazine, 2-ethyl-6-methylpyrazine, 2-ethyl-3,5-dimethylpyrazine, 3-ethyl-2,5-dimethylpyrazine, 5-ethyl-2,3-dimethylpyrazine, 2-propylpyrazine, 2-methyl-3-propylpyrazine, 2-methyl-6-propylpyrazine, 2,5-dimethyl-3-propylpyrazine, 3,5-dimethyl-2-propylpyrazine, 2-(1-methylethyl)pyrazine, 2-methyl-3-(1-methylethyl)pyrazine, 2-methyl-5-(1-methylethyl)-pyrazine, 6-methyl-2-(1-methylethyl)pyrazine, 2,3-diethylpyrazine, 2,3-diethyl-5-methylpyrazine, 3,5-diethyl-2-methylpyrazine, 2,6-diethyl-3,5-dimethylpyrazine, 2,5-diethyl-3,6-dimethylpyrazine, 2,5-bis(1-methylethyl)pyrazine, 2,5-dimethyl-3,6-bis(1-methylethyl)pyrazine, 2-butylpyrazine, 2-butyl-3-methylpyrazine, 2-butyl-6-methylpyrazine, 2-butyl-3,5-dimethylpyrazine, 3-butyl-2,5-dimethylpyrazine, 5-butyl-2,3-dimethylpyrazine, 2-butyl-3,5,6-trimethylpyrazine, 2,5-dibutyl-3,6-dimethylpyrazine, 2,5-dimethyl-3,6-bis(2-methylpropyl)pyrazine, 2,5-diethyl-3,6-bis(2-methylpropyl)-pyrazine, 2-methyl-3-(2-methylpropyl)pyrazine, 2,3,5-trimethyl-6-(2-methylpropyl)pyrazine, 2-methyl-3-pentylpyrazine, 2-hexylpyrazine, 2-hexyl-3-methylpyrazine, 2,3,5-trimethyl-6-nitropyrazine, mixtures thereof and the like.

Particularly suitable pyridines which can be employed herein include, for example, 2-methylpyridine, 4-methylpyridine, 2,3-dimethylpyridine, 2,4-dimethylpyridine, 2,5-dimethylpyridine, 2,6-dimethylpyridine, 2-ethylpyridine, 2,3,4-trimethylpyridine, 2,3,5-trimethylpyridine, 2,3,6-trimethylpyridine, 2,4,5-trimethylpyridine, 2,4,6-trimethylpyridine, 2-ethyl-3-methylpyridine, 2-ethyl-4-methylpyridine, 3-ethyl-2-methylpyridine, 3-ethyl-4-methylpyridine, 2-ethyl-6-methylpyridine, 5-ethyl-2-methylpyridine, 4-ethyl-2-methylpyridine, 2,4-diethylpyridine, 3,6-diethyl-2-methylpyridine, 2-ethyl-3,6-dimethylpyridine, 3-ethyl-2,6-dimethylpyridine, 4-ethyl-2,5-dimethylpyridine, 2-ethyl-4,6-dimethylpyridine, 2-methyl-4-propylpyridine, 2-methyl-4-(1-methylethyl)pyridine, 2-(1,1-dimethylethyl)-4-methylpyridine, 4-(1,1-dimethylethyl)-2-methylpyridine, 2,3-dimethyl-6-(1-methylethyl)pyridine, 3,6-dimethyl-2-(1-methylethyl)pyridine, 2,6-dimethyl-4-propylpyridine, 3,6-dimethyl-2-propylpyridine, 2-ethyl-3,4,6-trimethylpyridine, 3-ethyl-2,5,6-trimethylpyridine, 2-methyl-4-(1-methylpropyl)pyridine, 4-butyl-2-methylpyridine, 5-butyl-2-methylpyridine, 2,3,4,5-tetramethylpyridine, 2,3,4,6-tetramethylpyridine, 2,3,5,6-tetramethylpyridine, pentamethylpyridine, mixture thereof and the like.

Suitable pyrazoles include 3-methylpyrazole, 4-methylpyrazole, 3,5-dimethylpyrazole, 1-ethyl-3,5-dimethylpyrazole, 3,4,5-trimethylpyrazole, mixtures thereof and the like.

Suitable imidazoles which can be employed herein include, for example, 2-methylimidazole, 4-methylimidazole, 1,2-dimethylimidazole, 2,5-dimethylimidazole, 2,4-dimethylimidazole, 2,4,5-trimethylimidazole, 2-ethyl-4-methylimidazole, mixtures thereof and the like.

Suitable pyridazines include, for example, 3-methylpyridazine, 3,5-dimethylpyridazine, 3,4,5-trimethylpyridazine, 3,4-tripropylpyridazine, mixtures thereof and the like.

Suitable pyrimidines include, for example, 4-methylpyrimidine, 2,4-dimethylpyrimidine, 4,5-dimethylpyrimidine, 4,6-dimethylpyrimidine, 2,6-dimethyl-4-pyrimidinol, 2,4,6-trimethylpyrimidine, 2,4-diethylpyrimidine, mixtures thereof and the like.

Suitable purines which can be employed herein include, for example, 6-methylpurine, 2,8-dimethylpurine, 2,6,8-trimethylpurine, mixtures thereof and the like.

Suitable pteridines include 6,7-dimethylpteridine, 2,6-dimethylpteridine, 2,4,7-trimethylpteridine, mixtures thereof and the like.

Suitable triazines which can be employed herein include 3,5-dimethyl-1,2,4-triazine, 3,6-dimethyl-1,2,4-triazine, 2,4-dimethyl-1,3,5-triazine, 2,4,6-trimethyl-1,3,5-triazine, mixtures thereof and the like.

Suitable quinolines include, for example, 2-methylquinoline, 4-methylquinoline, 2,4-dimethylquinoline, 2,6-dimethylquinoline, 2,7-dimethylquinoline, 8-ethyl-2-methylquinoline, 4-ethyl-2,3-dimethylquinoline, 8-ethyl-2,3-dimethylquinoline, 4-ethyl-2,3,8-trimethylquinoline, 4,8-diethyl-2,3-dimethylquinoline, 2,3-dimethyl-8-propylquinoline, 2,3,4-trimethyl-8-propylquinoline, 2,4-dimethyl-6-(1-methylpropyl)quinoline, mixtures thereof and the like.

Suitable quinoxalines include 2-methylquinoxaline, 2,5-dimethylquinoxaline, 2,3-dimethylquinoxaline, 2,6-dimethylquinoxaline, 2,3,6-trimethylquinoxaline, 2,3,6,8-tetramethylquinoxaline, mixtures thereof and the like.

Suitable phthalazines which can be employed herein include 1-methylphthalazine, 4-methylphthalazine, 1,7-dimethylphthalazine, 1,5-dimethylphthalazine, mixtures thereof and the like.

Suitable quinazolines which can be employed herein include 2-methylquinazoline, 4-methylquinazoline, 2,4-dimethylquinazoline, 2,7-dimethylquinazoline, mixtures thereof and the like.

The aromatic heterocyclic materials having one or more rings and at least one nitrogen atom located in the ring and at least one substituent group which has at least one reactive hydrogen atom attached to a carbon atom which is attached to an aromatic heterocyclic ring can be mixed with each other. For example, 5-ethyl-2-methylpyridine can be mixed with 2-ethyl-3,5-dimethylpyrazine and used as the heterocyclic material in the present invention.

Suitable aldehydes and ketones which can be employed herein include, for example, all of those having the formula:

$$R^1-\overset{\overset{\displaystyle O}{\|}}{C}-R^2$$

wherein each $R^1$ and $R^2$ are independently hydrogen, hydrocarbyl or substituted hydrocarbyl groups having from 1–30 carbon atoms. Such substituents include, for example, halo, nitro, alkoxy and amino groups.

Particularly suitable aldehydes include, for example, formaldehyde, paraformaldehyde, acetaldehyde, 2-bromoacetaldehyde, benzaldehyde, propionaldehyde, butyraldehyde, caproaldehyde, crotonaldehyde, nicotinaldehyde, 2,2-dichloromalonaldehyde, gluteraldehyde, ptolualdehyde, 3-chlorobenzaldehyde, napthaldehyde, anthaldehyde, 2-furaldehyde, malonaldehyde, phthaldehyde, 3,5-dibromophthalaldehyde, 1-cyclohexene-1-carboxaldehyde, 3-quinolinecarboxaldehyde, 3-aminobenzaldehyde, combinations thereof and the like. Particularly suitable ketones include, for example, acetone, methyl ethyl ketone, 2-pentanone, 3-pentanone, 1-chloro-2-propanone, butyrone, 1-bromo-7-nitro-4-heptanone, acetophenone, 5,6,7,8-tetrahydro-1-isobutyronapthone, capriphenone, 1-cyclohexyl-2-methyl-1-propanone, 1-(2-furyl)-1-butanone, 1-(5-quinolyl)-1-pentanone, 2-acetylchrysene, 4-bromobenzophenone, 2,4-pentanedione, 3,4-diacetyl-2,5-hexanedione, 3-cyclohexene-1-one, 2-acetonyl cyclohexanone, mixtures thereof and the like.

Suitable catalysts which can be employed include, for example, acids, Lewis acids, bases or salts. Particularly suitable acids include, for example, hydrohalides, sulfuric or glacial acetic acid. Suitable hydrohalides include, for example, hydrochlorides, hydrobromides, hydroiodides, combinations thereof and the like. Particularly suitable bases include, for example, alkoxides and hydroxides of alkali or alkaline earth metals, such as sodium ethoxide, magnesium ethoxide and sodium hydroxide. Particularly suitable Lewis acids include, for example, boron trifluoride and aluminum trichloride. Particularly suitable salts include, for example, zinc chloride. The use of such catalysts is not indispensable but it reduces the time required for the reaction. The preferred catalyst is hydrochloric acid. The catalyst can be reacted or complexed with the amine, the hydrocarbyl substituted nitrogen-containing aromatic heterocyclic material, a mixture of amine and hydrocarbyl substituted nitrogen-containing aromatic heterocyclic material and a mixture or reaction product of amine, hydrocarbyl substituted nitrogen-containing aromatic heterocyclic material and aldehyde or ketone.

The catalysts can be added to the reactants separately or to any one or combination of the reactants prior to contact with the remainder of the reactants.

Suitable monoamines which can be employed herein include, for example, those amines having a combined total of at least seven carbon, nitrogen, oxygen or sulfur atoms and at least one reactive amine hydrogen atom. Such monoamines which can be employed herein include, for example, N-hexyl-1-hexanamine, N-octyl-1-octanamine, N-nonyl-1-nonanamine (Di-n-nonylamine), 3-isopropoxypropylamine, 3-(2-methoxyethoxy)-propylamine, N-(3-ethoxypropyl)ethylamine, 4,4-diethoxybutylamine, cyclohexanebutylamine, cyclooctylamine, cyclododecylamine, N-methylcyclododecylamine, octamethyleneimine, 4-hexyloxyaniline, 4-pentyloxyaniline, 1,4-benzodioxan-6-amine, 2-amino-4-tert-butylphenol, 2-biphenylamine, 4-biphenylamine, 2-aminonaphthalene, 2-fluorenamine, 1-anthramine, 4-phenylbutylamine, 2-(benzyloxy)ethylamine, 2-(β-phenethylamino)ethanethiol, 4-amino-1-benzylpiperidine, tall oil amine, soya amine, hydrogenated tallow amine, tallow amine, $C_8$–$C_{15}$ ether amine, mixtures thereof and the like. Particularly suitable monoamines include 1-hexanamine(hexylamine), 1-heptanamine, 1-octanamine, 1-nonanamine, 1-decanamine, 1-undecanamine, 1-dodecanamine (dodecylamine), 1-tridecanamine, 1-tetradecanamine, 1-pentadecanamine, 1-hexadecanamine, 1-heptadecanamine, 1-octadecanamine, N-methylhexanamine, N-methylheptanamine, N-methyl-1-decanamine, N-(1-methylethyl)-1-pentanamine, N-(1-methylethyl)-1-decanamine, N-methyl-1-octadecanamine, N-dodecyl-1-dodecanamine, 9-octadecen-1-amine, 9,12-octadecadien-1-amine, 9,12,15-octadecatrien-1-amine, 9-eicosen-1-amine, 11-eicosen-1-amine, mixtures thereof and the like.

Particularly suitable monoamines are the aliphatic primary amines having a combined total of from about 10 to about 20 carbon, nitrogen, oxygen or sulfur atoms or a mixture thereof.

Particularly suitable polyamines which can be employed in the preparation of the corrosion inhibitors include, for example, those represented by the following formulas I or II

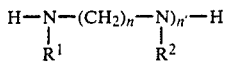

I.

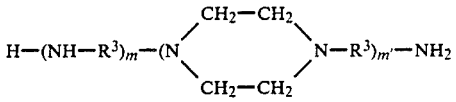

II.

where each $R^1$ and $R^2$ is independently hydrogen or a hydrocarbyl group or hydroxyl substituted hydrocarbyl group or amine substituted hydrocarbyl group having from about 2 to about 36, preferably from about 2 to about 24, more preferably from about 2 to about 10, most preferably from about 2 to about 3, carbon atoms; each $R^3$ is independently a divalent hydrocarbyl group having from 1 to about 36, preferably from about 1 to about 24, more preferably from about 1 to about 10, most preferably from about 1 to about 3, carbon atoms; m has a value from zero to about 8; m' has a value from 1 to about 4; n has a value of 2 to 20, preferably 2 to 3; n' has a value from 1 to about 10. The term hydrocarbyl as employed herein includes, alkyl, cycloalkyl, aryl, aralkyl, alkaryl, alkenyl and the like. Such amines include N-(2-aminoethyl)-1,2-ethanediamine, N-(3-aminopropyl)-1,3-propanediamine, N-(3-aminopropyl)-1,4-butanediamine, bis-(2-aminopropyl)amine, 1-piperazineethanamine, 2-(3-aminopropylamino)ethanol, 1-(2-aminoethylamino)-2-propanol, triethylenetetramine, tetraethylenepentamine, hexaethyleneheptamine, N,N-dibutyl-1,3-propanediamine, N,N'-dipropyl-1,7-heptanediamine, N,N'-dioctyl-1,2-ethanediamine, N,N'-dioctyl-1,3-propanediamine, N,N'-didecyl-1,3-propanediamine, N,N'-didecyl-1,3-propanediamine, 1,10-dodecanediamine, 1,12-dodecanediamine, N-decyl-1,2-ethanediamine, N-undecyl-1,2-ethanediamine, N-tridecyl-1,2-ethanediamine, N-pentadecyl-1,2-ethanediamine, N-hexadecyl-1,2-ethanediamine, N-heptadecyl-1,2-ethanediamine, N-octadecyl-1,2-ethanediamine, N-decyl-1,3-propanediamine, N-dodecyl-1,2-propanediamine, N-tetradecyl-1,3-propanediamine, N-hexadecyl-1,3-propanediamine, N-heptadecyl-1,3-propanediamine, N-octadecyl-1,2-propanediamine, N-octadecyl-1,3-propanediamine, N-octadecyl-1,4-butanediamine, mixtures thereof and the like. Other suitable polyamines which can be employed herein include, for example, 5,11-pentadecanediamine, 4,13-hexadecanediamine, 2,2,11-trimethyl-1,11-dodecanediamine, 5,13-diethyl-6,12-heptadecanediamine, 3,4-diethyl-4,13-hexadecanediamine, 12-ethyl-2-methyl-2-propyl-1,11-tetradecanediamine, 5,15-diethyl-5,14-nonadecanediamine, 6,9,12-trioxa-3,15-diazaheptadecane-1,17-diol, 3,6,9,12,15-pentaoxaheptadecane-1,17-diamine, N-[3-(decyloxy)propyl]-1,3-propanediamine, 1-[(2-aminoethyl)amino]-2-tetradecanol, 1-[(3-aminopropyl)amino]-2-dodecanol, 5-[(3-ethylamino)propyl]amino-1-pentanol, 1-piperazinepropanol, ether-1,3-propylenediamines, ether-1,2-ethylenediamines, mixtures thereof and the like.

The monoamines or polyamines can be partially alkoxylated such as partially ethoxylated, partially propoxylated, partially butoxylated or partially polyethoxylated, partially polypropoxylated or partially polybutoxylated, provided that there remains at least one amine hydrogen atom or molecule. Also suitable are the aminated polyols. Suitable such aminated polyols include, for example aminated ethylene glycol, aminated polyoxyethylene glycol, aminated propylene glycol, aminated polyoxypropylene glycol, aminated glycerine, aminated reaction products of ammonia or an amine such as methylamine, ethylamine, propylamine, butylamine, ethylenediamine, propylene diamine, diethylenetriamine or the like with an alkylene oxide such as ethylene oxide, propylene oxide, butylene oxide, mixture thereof and the like, aminated reaction products of trimethylol propane with an alkylene oxide such as ethylene oxide, propylene oxide, butylene oxide, mixtures thereof and the like. Suitable such aminated polyols include those disclosed in U.S. Pat. No. 4,374,222 which is incorporated herein by reference.

Thermal stability and film forming tenacity of a corrosion inhibitor is usually improved by some degree from crosslinking of the reactants. Polyamines can be mixed with monoamines to crosslink the reactants. Another necessary criterion for crosslinking the reactants is the presence of a nitrogen-containing aromatic heterocyclic material having one or more hydrocarbyl substituents with at least two reactive hydrogen atoms attached to a carbon atom or carbon atoms attached to the aromatic heterocyclic ring as a reactant. Polyamines with seven or less atoms are as suitable for crosslinking as those polyamines with at least seven atoms listed above. Suitable polyamines with seven or less atoms are 1,2-ethanediamine (ethylenediamine), piperazine, N-methyl-1,2-ethanediamine, 1,3-propanediamine, 1,2-propanediamine, 1,4-butanediamine, mixtures thereof and the like.

The acid catalyzed reaction product of the hydrocarbyl substituted aromatic nitrogen heterocyclic material, amine and aldehyde and/or ketone are believed to be those compounds or mixtures of compounds represented by the following formulas III, IV, V, VI or VII:

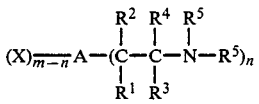

III.

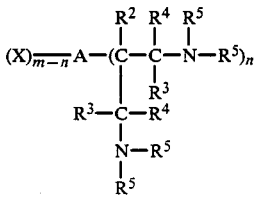

IV.

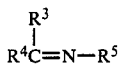

V.

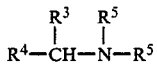

VI.

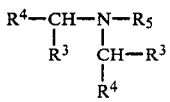

VII.

wherein $R^1$ and $R^2$ are independently hydrogen or a hydrocarbyl group containing 1 to about 10, preferably from 1 to about 2 carbon atoms; each $R^3$ and $R^4$ are independently hydrogen, hydrocarbyl or halo, nitro, alkoxy or amino substituted hydrocarbyl group having from 1 to about 30 carbon atoms; each $R^5$ is independently hydrogen, or a substituent group having a combined total of at least six carbon, nitrogen, oxygen or sulfur atoms; each X is independently hydrogen, methyl, $—CH(R)_2$ or $—CH_2R$ groups wherein each R is independently a hydrocarbyl group containing from 1 to about 10, preferably from 1 to about 2 carbon atoms; A is either the pyrazine, pyridine, pyrazole, imidazole, pyridazine, pyrimidine, purine, pteridine, quinoline or quinoxaline nucleus; m has a value of 3 when A is a pyrazole, imidazole, purine or triazine, 4 when A is a pyrazine, pyridazine, pyrimidine or pteridine, 5 when A is pyridine, 6 when A is quinoxaline, quinazoline or phthalazines and 7 when A is quinoline; n has a value from 1 to m. The compound represented by formula IV is only formed when $R^1$ of the substituent group of the aromatic nitrogen-containing heterocyclic compound is a hydrogen. Similarly, the compound represented by formulas V and VII are only formed when one of the two $R^5$ groups of the amine is a hydrogen.

In addition to the compounds represented by formulas III, IV, V, VI and VII, the reaction of the hydrocarbyl substituted aromatic nitrogen heterocyclic material, amine and aldehyde and/or ketone are believed to form a high molecular weight product or polymer of unknown composition. The presence of the high molecular weight product or polymer is suggested by gel permeation chromatography with tetrahydrofuran as the solvent. For example, some 2700 molecular weight material was found to be present in the reaction product of 2,4,6-trimethylpyridine, formaldehyde and KEMAMINE TM P-650. Molecular weight was based upon polystyrene standards.

Compounds represented by formulas III and IV each have at least one

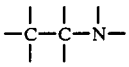

linkage. The

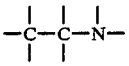

linkage results from the condensation of the amine and the hydrocarbyl substituted aromatic nitrogen containing heterocyclic material with the aldehyde and/or ketone under conditions sufficient to form a molecule of water. The two hydrogens of the water molecule are believed to originate from the reactive amine hydrogen of the amine and the reactive hydrogen atom attached to the carbon atom which is attached to the aromatic heterocyclic ring, respectively.

The compositions of the present invention can be employed as a corrosion inhibitor as are conventional corrosion inhibitors. Generally, the product can be employed in corrosion inhibitor formulations as are known in the art. For example, the product can be dispersed or dissolved in a suitable carrier liquid or solvent such as water, alcohols, aromatic and aliphatic hydrocarbons, and the like, or mixtures thereof. Other additives include demulsifiers, water wetting agents, surfactants, viscosifiers, commingled gases, defoamers, other corrosion inhibitors such as polymeric materials and salts, organic and inorganic acids, iron control agents, sequestering and/or chelating agents, phosphates, quaternaries, amine salts, and the like. For example, surface active agents are used to assure complete dispersion of active ingredients throughout the corrosion inhibitor composition and thus provide a better contact of the corrosion inhibitor with the surface of the metal compound which is being protected. The corrosion inhibitors of this invention form films on metal surfaces at least as readily as those known film forming corrosion inhibitors.

The corrosion inhibitor of this invention is employed in a functionally effective amount. That is, any quantity of corrosion inhibitor which will provide some degree of inhibition of corrosion is sufficient. Typical amounts of corrosion inhibitor which are employed in an oil and/or gas well treatment can range from about one to about 2,000 ppm for continuous treatment or about 200 to about 50,000 ppm for squeeze treatment, based on the weight of corrosive well fluids in contact with the metal compositions which are protected. Amounts of corrosion inhibitor in excess of 50,000 ppm can provide additional corrosion inhibition but an increased expense.

The corrosion inhibitors of this invention are highly stable to high temperatures and high pressures. Typically, corrosion inhibitors for oil and gas wells are employed in applications where temperatures range from about 100° F. (37.7° C.) to in excess of about 500° F. (260° C.), depending upon the composition of the product. The corrosion inhibitors of this invention are especially useful at temperatures ranging from 300° F. (148.8° C.) to about 450° F. (232.2° C.).

The corrosion inhibitors of this invention inhibit corrosion to metal compositions used in down hole applications, preferably in excess of 80 percent corrosion protection. The corrosion inhibitors advantageously inhibit corrosion of metal compositions at elevated temperatures exceeding 250° F. in oil and gas well applications. Useful applications include oil and/or gas well drilling, completion, workover, stimulation, transfer, processing and storage applications. The corrosion inhibitors are also useful for the protection of metal against corrosion in geothermal wells.

The following examples are illustrative of the present invention.

CORROSION TESTING

175° F. (79.4° C.)

Corrosion inhibition of various samples was determined under conditions which stimulate conditions that exist in oil and gas wells as follows. A brine solution containing 89.89 percent deionized water, 9.62 percent sodium chloride, 0.305 percent calcium chloride and a 0.186 percent hydrated magnesium chloride complex was prepared. This brine solution was purged with carbon dioxide until a pH of 3.8 was achieved. The solution was treated with sodium persulfate to remove oxygen. The desired corrosion inhibitor was added to the solution. About 720 milliliters (ml) of this brine solution and 80 ml of kerosene (90% brine/10% kerosene) treated with sodium persulfate were charged into a 32-ounce bottle. To this charge was added enough hydrated sodium sulfide to generate a suitable amount of hydrogen sulfide (i.e., about 300 ppm hydrogen sulfide based on total fluids).

Metal coupons (12"×¼"×1/16", 304.8 mm×6.35 mm×1.59 mm) of 1020 carbon steel were degreased with an inhibited methylchloroform, acidized with 16 percent hydrochloric acid, washed and dried. Each coupon weighed about 19 g. A metal coupon was placed in the bottle containing the brine, kerosene and ingredients as previously described. The bottle was capped and acetic acid was injected into the bottle through a septum. The bottle was placed on a vertically rotating wheel held at 175° F. (79.4° C.) and the sample was rotated at 26 rpm for 24 hours (86400 s). The coupons were removed from the bottle, cleaned, washed, dried and reweighed and the percent protection afforded them by the inhibitor is calculated as the percent protection by the following formula:

$$\% \text{ protection} = 100 - \frac{\text{inhibitor coupon wt. loss}}{\text{blank coupon wt. loss}} \times 100$$

The weight loss is given to the nearest whole percent. The tests wherein no inhibitor is employed are for comparative purposes and are designated as blanks.

The corrosion rates are also determined in milliinches per year (mpy) by the following formula:

$$mpy = \frac{534 \text{ (Mg Weight Loss of Coupon)}}{d \times a \times t}$$

d=density of 1020 carbon steel=7.86 g/ml
a=surface area (in.) of metal coupons
t=test time in hours

CORROSION TESTING

350° F. (177° C.)

The performance of 100 ppm of a corrosion inhibitor sample also was tested in a 24 hour 350° F. (177° C.) wheel test containing 90 percent brine/8 percent heptane/2 percent kerosene at 2,000 psi pressure (25° C.) with 10 percent hydrogen sulfide, 10 percent carbon dioxide and 80 percent methane in a stainless steel pipe bomb. Metal coupons (6"×¼"×1/16", 152.4 mm×6.35 mm×1.59 mm) of 1020 carbon steel were degreased with chlorothene, scrubber, washed with acetone and dried before being placed in the pipe bomb. After the test, the coupons were removed from the pipe bomb, scrubbed, washed with acetone and dried. Percent protection and milliinches per year (mpy) corrosion rates were calculated using the same equations as in the above 175° F. corrosion test.

EXAMPLE 1

214.95 grams (1.05 moles) of KEMAMINE TM P-650 were added to a one-liter resin kettle equipped with a thermometer, mechanical stirrer, condenser, and addition funnel. KEMAMINE TM P-650 is a mixture of $C_{10}$–$C_{18}$ primary amines commercially available from Witco Chemical Corp. which consists primarily of 1-decanamine, 1-dodecanamine, 1-tetradecanamine, 1-hexadecanamine, 1-octadecanamine and octadecen-1-amine. A nitrogen atmosphere was maintained on the system. The fatty amines were stirred and cooled to 10° C. Then 119.52 grams (1.21 moles) of 37% concentrated hydrochloric acid were added dropwise over a 70 minute (4200 s) period to form amine hydrochlorides. 54 grams (0.5 mole) of 2,5-dimethylpyrazine were similarly added during a 15 minute (900 s) period.

The mixture was then heated to 104° C. where water began to reflux. 154.54 grams (1.89 moles) of 37% aqueous formaldehyde were added dropwise in 117 minutes (7020 s). The reactants were kept at the water reflux temperature for an additional 120 minutes (7200 s).

Electron impact capillary chromatography mass spectrometry indicated the presence of the following constituents,

| | |
|---|---|
| $CH_2{=}N{-}(CH)_{11}CH^3$ | MW = 197 |
| $CH_3NH(CH)_{11}CH^3$ | MW = 199 |
| $CH_3NH(CH)_{13}CH^3$ | MW = 227 |
| $CH_3NH(CH)_{15}CH^3$ | MW = 255 |

and N-dodecyl-5-methyl-2-pyrazineethanamine,

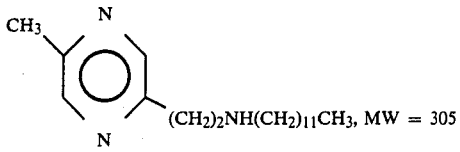

In addition, methane chemical ionization probe mass spectrometry showed the presence of M+1 ions of 362 and 559 which are indicative of the following constituents,

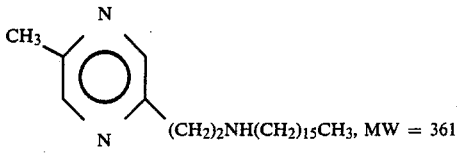

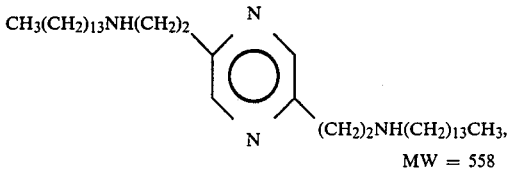

EXAMPLE 2

112.9 grams of the reaction product from Example 1 were placed in a one-liter beaker equipped with a stirring bar. Sufficient 1N NaOH solution was added while stirring with a magnetic stirrer to neutralize the product. The product was extracted with chloroform and the aqueous layer was separated and discarded. Neutralized product was obtained by rotary evaporation under full vacuum at 100° C. for 2 hours (7200 s) to remove the chloroform. Then isopropanol was added to the solid product and similarly rotary evaporated to aid in the removal of water. A black product was recovered. The black product was dissolved in xylene for the corrosion inhibition tests.

EXAMPLE 3

A mixture of 145.4 grams of reaction product for Example 1 and 300 milliliters of chloroform were mixed in a one-liter round bottom flask for several minutes to extract the reaction product (crude and unneutralized). The aqueous layer was separated and discarded. The chloroform layer was rotary evaporated under full vacuum at 100° C. Then isopropanol was added to the product and similarly removed by vacuum rotary evaporation to obtain a moisture free dark solid product.

EXAMPLE 4

215.34 grams (1.05 moles) of KEMAMINE TM P-650 were added to a one-liter resin kettle equipped with a thermometer, mechanical stirrer, condenser, addition funnel, and a nitrogen pad. The fatty amines were cooled to 19° C. and 100 milliliters of 37% hydrochloric acid were added in 54 minutes (3240 s) to form amine hydrochlorides. 40.2 grams of 2,4,6-trimethylpyridine (0.33 mole) were added while stirring over an 18 minute (1080 s) period. The temperature increased from 20° to 60° C. The mixture was heated to 108° C. and a nitrogen sweep was employed to aid in the removal of water via a Barrett trap. The light yellow viscous material was heated to 127° C. at which point a minimal amount of water was collected.

97.55 grams (1.2 moles) of 37% aqueous formaldehyde were introduced dropwise via an addition funnel in 135 minutes (8100 s). The temperature increased from 125° to 170° C. during the addition of formaldehyde. The reactants were then heated for an additional 75 minutes (4500 s) at 185° C. 299.1 grams of water soluble leather brown product were recovered.

EXAMPLE 5

30.07 grams of the crude reaction product of 2,4,6-trimethylpyridine/formaldehyde/KEMAMINE TM P-650 from Example 4 were placed in a 300 milliliter beaker. 60.1 grams of deionized water were added to solubilize the product. The contents were heated with stirring to accelerate the solubilization process. Then 19.8 milliliters of 30% NaOH (0.2 mole) were added to raise the pH of the solution from 1.51 to 12. A black organic phase physically separated from the water phase. The organic phase was taken up in chloroform and the water phase separated and discarded. The chloroform was removed by vacuum rotary evaporation under full vacuum at 100° C. Following the removal of chloroform, 100 mls of anhydrous isopropanol were added and similarly retary evaporated.

22.99 grams of a black viscous oily product were collected. Capillary chromatography mass spectrometry showed the presence of 4,6-dimethyl-N-pentadecyl-2-pyridineethanamine,

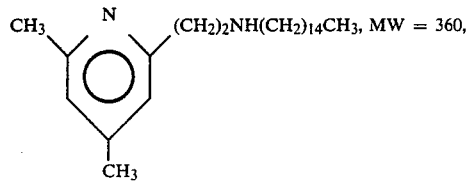

4,6-dimethyl-n-heptadecyl-2-pyridineethanamine,

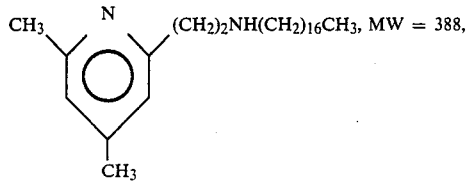

and the following products

| | |
|---|---|
| $CH_3NH(CH)_{11}CH_3$ | MW = 199 |
| $CH_2{=}N(CH_2)_{13}CH_3$ | MW = 225 |
| $CH_3NH(CH_2)_{14}CH_3$ | MW = 241 |
| $CH_3NH(CH_2)_{13}CH_3$ | MW = 227 |

-continued

| | |
|---|---|
| $(CH_3)_2N(CH_2)_{17}CH_3$ | MW = 297 |

Gel permeation chromatography with tetrahydrofuran as the solvent indicated the weight-average and z-average molecular weight of the black liquid were 376 and 617, respectively. Some 2700 molecular weight material was present. The weight-average and z-average molecular weight of KEMAMINE TM P-650 was 233 and 248, respectively. Molecular weights were based upon polystyrene standards.

EXAMPLE 6

56.06 grams of KEMAMINE TM P-650 (0.27 mole) were weighed into a 250 milliliter 4 neck round bottom flask equipped with an immersion thermometer, mechanical stirrer, condenser and addition funnel. A nitrogen atmosphere was maintained throughout the reaction. The fatty amines were stirred and cooled to 15° C. 29.29 milliliters of 37% hydrochloric acid (0.26 mole) were added dropwise over a ten minute (600 s) period to form amine hydrochlorides. Then 19.11 grams (0.12 mole) of 2,6-dimethylquinoline were added to the reactor contents. The reactor contents were then heated to 100° C. where 21.79 grams of 37% aqueous formaldehyde (0.26 mole) solution were added dropwise over 60 minutes (3600 s). The reactor contents were heated at 100° C. for an additional 70 minutes (4200 s). A Barrett trap was installed and water (63 grams) was removed from the reactor giving a dark brown solid (87.82 grams). The infrared spectrum of the dark brown solid indicated the presence of methylene groups, amine salt, imine and quinoline. Absorption bands at 720 $cm^{-1}$, 1465 $cm^{-1}$, 2850 $cm^{-1}$ and 2920 $cm^{-1}$ supported the presence of methylene groups. A combination of medium intensity bands between 2000 $cm^{-1}$–2800 $cm^{-1}$ were attributed to the presence of an amine salt. The band at 1688 $cm^{-1}$ was assigned to the C=N stretch of a imine. The presence of quinoline was supported by bands at 1595 $cm^{-1}$, 1495 $cm^{-1}$, 880 $cm^{-1}$ and 830 $cm^{-1}$. The dark brown solid was dissolved in ethanol for the corrosion inhibition tests.

EXAMPLE 7

20.94 grams of the dark brown solid described in Example 6, 110 milliliters of water and 6 milliliters of an aqueous solution of 50% sodium hydroxide (0.115 mole) were stirred until complete neutralization. 600 milliliters of chloroform were added to the neutralized mixture, mixed and then the chloroform layer separated from the aqueous layer. The chloroform was removed from the neutralized product by rotary evaporation under full vacuum at 100° C. Isopropanol was added and removed by rotary evaporation under full vacuum at 100° C. giving 19.7 grams of a black liquid. The proton ('H) nuclear magnetic resonance (NMR) spectrum of the black liquid showed an absorption at 6.8 parts per million which was attributed to the aromatic protons of alkyl substituted quinoline. The infrared spectrum of the black liquid resembled the spectra in Example 6 except the combination of medium intensity bands between 2000 $cm^{-1}$–2800 $cm^{-1}$ were absent and the 1688 $cm^{-1}$ band assigned to C=N stretch had broadened and now was located at 1668 $cm^{-1}$. Gel permeation chromatography with tetrahydrofuran as the solvent indicated the z-average molecular weight of the liquid was 374. Some 1250 molecular weight material was present.

EXAMPLE 8

54.71 g of KEMAMINE TM P-650 (0.27 mole) were weighed into a reactor of the type described in Example 6. The fatty amines were stirred and cooled to 15° C. in a nitrogen atmosphere. 23.7 grams of 37% hydrochloric acid (0.24 mole) were added together dropwise over a ten minute (600 s) period to form fatty amine hydrochlorides. After 20.6 grams (0.22 mole) of 3-methylpyridazine were added to the reactor contents, they were heated to 100° C. and allowed to reflux. Then 21 grams of 37% formaldehyde (0.26 mole) solution were added dropwise over a 19 minute (1140 s) period. After a Barrett trap was added to aid in removal of water, the reactor contents were heated to 130° C. over a period of 80 minutes (4800 s). A dark blood red solid was recovered as the final product. The infrared spectrum of the dark blood red solid supported the presence of methylene groups, amine salt, imine and pyridazine. Bands at 722 $cm^{-1}$, 1468 $cm^{-1}$, 2850 $cm^{-1}$ and 2920 $cm^{-1}$ supported the presence of methylene groups. A combination of medium intensity bands between 2000 $cm^{-1}$–2800 $cm^{-1}$ supported the presence of an amine salt. The band at 1690 $cm^{-1}$ was attributed to the C=N stretch of an imine. Bands at 850 $cm^{-1}$, 1008 $cm^{-1}$, 1040 $cm^{-1}$, 1255 $cm^{-1}$, 1380 $cm^{-1}$, 1440 $cm^{-1}$ and 1585 $cm^{-1}$ were attributed to the presence of pyridazine. The dark blood red solid was dissolved in water for the corrosion inhibition tests.

EXAMPLE 9

46.19 grams of the dark blood red solid described in Example 8, 127.88 grams of water and 10 ml of an aqueous solution of 50% sodium hydroxide (0.125 mole) solution were stirred for ten minutes (600 s). 500 milliliters of chloroform were added to the neutralized product, mixed and then the chloroform layer was separated from the aqueous layer. A black oily liquid was recovered after the removal of the chloroform by rotary evaporation under full vacuum at 100° C. Isopropanol was added to the black liquid and the isopropanol removed by rotary evaporation under full vacuum at 100° C. 38.2 grams of the black liquid were recovered as the final neutralized product. The 'H NMR spectrum of the black liquid showed an absorption at 7.27 parts per million which was attributed to the aromatic protons of the alkyl substituted pyridazine.

EXAMPLE 10

76.04 grams of KEMAMINE TM P-650 (0.37 mole) were weighed into a reactor of the type described in Example 6. A nitrogen atmosphere was maintained throughout the reaction. After the fatty amines were stirred and cooled to 10° C., 45.12 grams of 37% concentrated hydrochloric acid (0.46 mole) were added dropwise over a 74 minute (4440 s) period to form the amine hydrochlorides. After 19.4 grams (0.179 mole) of 4,6-dimethylpyrimidine were added to the reactor contents, they were heated to 102° C. and allowed to reflux. 61.17 grams of 37% aqueous formaldehyde (0.75 mole) solution were added dropwise over 3 hours (10800 s) giving a reddish brown viscous liquid. After the reactants were heated for 78 minutes (4680 s) between 89°–107° C., a Barrett trap was installed to aid in the removal of water. The reactor contents were heated an additional 75 minutes (4500 s) between 100°–113° C. On cooling to room temperature, the reactor contents were a reddish brown waxy solid that was soluble in water, ethanol, diethyl ether and xylene. Ethanol was added to the reddish brown waxy solid giving a slurry that was rotary evaporated under full vacuum at 100° C. A brown solid was recovered as the final product. The infrared spectrum of the reddish brown waxy solid supported the presence of methylene groups, amine salt, imine and pyrimidine. The presence of methylene groups was supported by bands at 722 $cm^{-1}$, 1470 $cm^{-1}$, 2855 $cm^{-1}$ and 2930 $cm^{-1}$. A combination of medium intensity bands between 2000 $cm^{-1}$–2800 $cm^{-1}$ supported the presence of an amine salt. A broad band between 1650 $cm^{-1}$ and 1710 $cm^{-1}$ was assigned to the C=N stretch of a imine. Absorption bands at 930 $cm^{-1}$, 995 $cm^{-1}$ and 1525 $cm^{-1}$ were attributed to the presence of pyrimidine. Gel permeation chromatography of the tetrahydrofuran soluble portion of the reddish brown solid indicated the weight-average and z-average molecular weight was 306 and 756, respectively. Some 2000 molecular weight material was present. The brown solid was dissolved in xylene for the corrosion inhibition tests.

EXAMPLE 11

13.72 grams of the brown solid in Example 10 were weighed onto an aqueous solution of 55% sodium hydroxide (101 grams). After stirring, the brown solid layered on top of the aqueous solution of sodium hydroxide. The brown solid was separated from the sodium hydroxide with a separatory funnel. The brown solid was dissolved in xylene for the corrosion inhibition tests.

EXAMPLE 12

22.53 grams of the brown solid described in Example 11, 100.2 grams of water, and 69.7 grams of anhydrous diethyl ether were stirred. The diethyl ether layer was separated from the aqueous layer with a separatory funnel and discarded. 141.6 grams of diethyl ether were added to the aqueous layer and stirred. The diethyl ether layer was removed and discarded. 70.4 grams of diethyl ether and 44.3 grams of an aqueous solution of 59% sodium hydroxide were added to the aqueous layer. The resulting diethyl ether layer was removed, and rotary evaporated under full vacuum at 100° C. to give a dry brown solid. The brown solid was dissolved in hot xylene for the corrosion inhibition tests.

EXAMPLE 13

66.64 grams of KEMAMINE TM P-650 (0.33 mole) were weighed into a reactor of the type described in Example 6. The fatty amines were stirred and cooled to 10° C. in a nitrogen atmosphere. 38.62 g of 37% hydrochloric acid (0.39 mole) were added dropwise over a 33 minute (1980 s) period to form the fatty amine hydrochlorides. After 25.82 grams (0.16 mole) of 2,3-dimethylquinoxaline were added to the reactor contents, the reactants were heated to 103° C. and allowed to reflux. Then 52.31 grams of an aqueous 37% formaldehyde (0.64 mole) solution were added dropwise over a 110 minute (6600 s) period. After a Barrett trap was installed to remove water, the reactor contents were heated between 100°–125° C. for an additional 147 minutes (8820 s). A black waxy solid that was soluble in ethanol and xylene was recovered as the final product. The black waxy solid was ground to fine powder and rotary evaporated under full vacuum at 100° C. Ethanol was added to the black powder and the ethanol removed by rotary evaporation under full vacuum at 100° C. The infrared spectrum of the black waxy powder supported the presence of methylene groups, amine salt, imine and quinoxaline. The presence of methylene groups was supported by absorption bands at 722 $cm^{-1}$, 1467 $cm^{-1}$, 2850 $cm^{-1}$ and 2925 $cm^{-1}$. A combination of medium intensity bands between 2000 $cm^{-1}$–2800 $cm^{-1}$ are explained by the presence of an amine salt. A broad band between 1640 $cm^{-1}$ and 1690 $cm^{-1}$ was assigned to the C=N stretch of a imine. Absorption bands at 765 $cm^{-1}$, 1197 $cm^{-1}$, 1205 $cm^{-1}$ and 1382 $cm^{-1}$ supported the presence of quinoxaline. The black powder was dissolved in ethanol for the corrosion inhibition tests.

EXAMPLE 14

8.64 grams of the black powder described in Example 13 were weighed onto an aqueous solution of 55% sodium hydroxide (169 grams). After stirring, the black powder layered on top of the aqueous solution of sodium hydroxide. The aqueous solution of sodium hydroxide was removed from the black powder with a separatory funnel. The black powder was dried by using rotary evaporation under full vacuum at 100° C. The black powder was dissolved in isopropanol for the corrosion inhibition tests.

EXAMPLE 15

10.66 grams of the black powder described in Example 13, 158.3 grams of water, and 108.1 grams of diethyl ether were mixed and transferred to a separatory funnel. The aqueous layer was removed and discarded. An aqueous solution of 58.6% sodium hydroxide (109 grams) was added to the diethyl ether layer. After stirring, 34.9 grams of diethyl ether were added to the mixture. The aqueous solution of sodium hydroxide was removed with a separatory funnel and discarded. The diethyl ether layer was rotary evaporated under full vacuumm at 100° C. giving a dark brown viscous liquid. The infrared spectrum of the dark brown liquid was similar to the spectra in Example 14 except the combination of medium intensity bands between 2000 $cm^{-1}$–2800 $cm^{-1}$ were absent, and the bands assigned to C=N stretch and quinoxaline were more intense. The dark brown viscous liquid was dissolved in ethanol for the corrosion inhibition tests.

EXAMPLE 16

46.93 grams of KEMAMINE TM P-650 (0.23 mole) were weighed into a reactor of the type described in Example 6. A nitrogen atmosphere was maintained throughout the reaction. 26.6 grams of 37% concentrated hydrochloric acid (0.27 mole) were added dropwise over a 21 minute (1260 s) period to the cooled and stirred fatty amines. After 20.23 grams of a mixture consisting of 40.8 area percent 5-ethyl-2-methylpyridine, 42.0 area percent 3-ethyl-2,5-dimethylpyrazine and 3-ethyl-2,6-dimethylpyridine, and 17.2 area percent of a mixture of 2-methylpyridine, 2,6-dimethylpyridine, 2,3-dimethylpyridine, 2,3,6-trimethylpyridine, 3-ethyl-4-methylpyridine, 2,3,5-trimethylpyridine, 2-ethyl-4,6-dimethylpyridine, 3-methyl-5-propylpyridine, $C_5$-pyridine, $C_5$-pyrazine and $C_6$-pyrazine were added to the reactor contents, they were heated to 100° C. and allowed to reflux. The area percent of the constituents in the mixture was determined by using gas chromatography. 37.33 grams of 37% aqueous formaldehyde (0.46 mole) solution were added dropwise over 27 minutes (1620 s) giving a dark brown liquid. After the reactants were heated for an additional 293 minutes (17,580 s) between 99°-100° C., a Barret trap was installed. The reactants were heated an additional 85 minutes (5100 s) between 106°-182° C. On cooling to room temperature, the reactor contents were a dark reddish brown viscous liquid that was soluble in ethanol or xylene. The dark reddish brown viscous liquid was dissolved in xylene for the corrosion inhibition tests.

EXAMPLE 17

24.87 grams of the dark reddish brown viscous liquid in Example 16 were added to an aqueous solution of 41% sodium hydroxide (203.30 g) and stirred for 23 minutes (1380 s). After the stirring, the brown liquid layered on top of the aqueous solution of sodium hydroxide. The brown liquid was separated from the sodium hydroxide with a separatory funnel. The brown liquid was dissolved in xylene for the corrosion inhibition tests.

EXAMPLE 18

51.44 grams of KEMAMINE TM P-650 (0.25 mole) and 13.30 g of triethylenetetramine (0.08 mole) were weighed into a reactor of the type described in Example 6. A nitrogen atmosphere was maintained throughout the reaction. 48.36 grams of 37% concentrated hydrochloric acid (0.49 mole) were added dropwise over 18 minute (1080 s) period to the cooled and stirred fatty amines. After 20.19 grams (0.17 mole) of 2,4,6-collidine were added to the amine hydrochlorides, the reactor contents were heated to 107° C. and the resultant clear yellow liquid was allowed to reflux. 54.23 grams of 37% aqueous formaldehyde (0.67 mole) solution were added dropwise over 40 minutes (2400 s) giving a dark reddish brown liquid. After the reactants were heated for 4 hours (14,400 s) between 98°-100° C., a Barret trap was installed to remove water. The reactor contents were heated an additional 77 minutes (4620 s) between 98°-182° C. On cooling to room temperature, the reactor contents were a dark reddish brown waxy solid. 24.01 grams of the reddish brown solid were layered on top of an aqueous solution of 57% sodium hydroxide (108.07 grams). The brown solid was separated from the aqueous solution of sodium hydroxide with a separatory funnel. The brown solid was subjected to rotary evaporation under full vacuum at 100° C. The brown solid was dissolved in ethanol for the corrosion inhibition tests.

EXAMPLE 19

50.5 grams (0.27 mole) of tetraethylenepentamine was weighed into a reactor of the type described in Example 6. 37.01 grams of 37% concentrated hydrochloric acid (0.38 mole) were added dropwise over a 18 minute (1080 s) period to the cooled and stirred polyamine in a nitrogen atmosphere. After 30.40 grams (0.25 mole) of 2,4,6-collidine were added to the amine hydrochlorides, the reactor contents were heated to 125° C. and the resultant transparent orange liquid was allowed to reflux. 31.07 grams of 37% aqueous formaldehyde (0.38 mole) solution were added dropwise over 34 minutes (2040 s) giving a reddish brown colored liquid. After the reactants were heated for 5 hours 24 minutes between 120°-122° C., a Barrett trap was installed to remove water. The reactor contents were heated an additional 46 minutes (2760 s) between 119°-147° C. On cooling to room temperature, the reactor contents were a reddish brown colored liquid that contained 66% active product. The reddish brown liquid was dissolved in ethanol for the corrosion inhibition tests.

The following example illustrates that a ketone such as acetone can be substituted for the aldehyde.

EXAMPLE 20

87.05 grams of KEMAMINE TM P-650 (0.43 mole) were weighed into a reactor of the type described in Example 6. A nitrogen atmosphere was maintained throughout the reaction. 45.79 grams of 37% aqueous hydrochloric acid (0.46 mole) were added dropwise over 27 minutes (1620 s) period to the cooled and stirred fatty amines. After 24.42 grams of 2,4,6-collidine (0.2 mole) were added to the reactor contents, they were heated to 65° C. and 46.61 grams of acetone (0.80 mole) were added over a 75 minute (4500 s) period. The reactor contents were allowed to reflux for 19 hours 20 minutes (69,600 s) giving a lime green colored liquid. 100 ml of n-butanol was added to the reactor and a Barrett trap installed. In 75 minutes (4500 s), the reactor contents were heated to 200° C. After cooling to room temperature, the reactor contents were a brittle light tan solid that was soluble in ethanol and water. The brittle light tan solid was dissolved in ethanol for the corrosion inhibition tests.

The following examples illustrate that a catalyst such as hydrochloric acid can be reacted or complexed with the alkyl substituted nitrogen-containing aromatic heterocyclic material, a mixture of amine and alkyl substituted nitrogen-containing aromatic heterocyclic material or a mixture or reaction product of amine, alkyl substituted nitrogen-containing aromatic heterocyclic material and aldehyde or ketone.

EXAMPLE 21

20.26 grams of 2,4,6-collidine (0.17 mole) were weighed into a reactor of the type described in Example 6. A nitrogen atmosphere was maintained throughout the reaction. 19.79 grams of 37% aqueous hydrochloric acid (0.20 mole) were added over five minutes (300 s) period to the cooled and stirred 2,4,6-collidine. After 68.04 grams of KEMAMINE TM P-650 (0.33 mole) and 17.90 g n-butanol were added to 2,4,6-collidine hydrochloride, they were heated to 106° C. and allowed to reflux. 53.81 grams of 37% aqueous formaldehyde (0.66 mole) solution were added dropwise over 54 minutes (3240 s) giving a cloudy yellow liquid. After the reactants were heated for an additional 246 minutes (14,760 s) between 98°-100° C., a Barrett trap was installed to remove water. The reactants were heated an additional 63 minutes (3780 s) between 99°-182° C. On cooling to room temperature, the reactor contents were a orange brown waxy solid that was soluble in methanol and ethanol. The orange brown waxy solid was dissolved in ethanol for the corrosion inhibition tests.

EXAMPLE 22

24.17 grams of 2,4,6-collidine (0.2 mole) were weighed into a reactor of the type described in Example 6. A nitrogen atmosphere was maintained throughout the reaction. 19.62 grams of 37% aqueous hydrochloric acid (0.2 mole) were added over four minute (240 s) period to the cooled and stirred 2,4,6-collidine giving a pinkish and white solid.

69.10 grams of KEMAMINE TM P-650 (0.34 mole) were weighed into another reactor of the same type as above. 39.66 grams of 37% aqueous hydrochloric acid (0.41 mole) were added over 12 minute (720 s) period to the cooled and stirred fatty amines giving a white solid.

35 milliliters of N-butanol were added to the reactor containing 2,4,6-collidine hydrochloride and the reactor contents transferred to the reactor containing the fatty amine hydrochlorides. The resulting brown colored slurry was heated to 98° C. and allowed to reflux. 54.79 grams of 37% aqueous formaldehyde (0.68 mole) solution were added dropwise over 46 minutes (2760 s) giving a light brown transparent liquid. After the reactants were heated 295 minutes (17,700 s) between 98°-99° C., a Barrett trap was installed to remove water. The reactants were heated an additional 78 minutes (4680 s) between 95°-197° C. On cooling to room temperature, the reactor contents were a orange brown solid that were soluble in ethanol.

EXAMPLE 23

67.28 grams of KEMAMINE TM P-650 (0.33 mole) and 21.43 grams of 2,4,6-collidine (0.18 mole) were weighed into a reactor of the type described in Example 6. A nitrogen atmosphere was maintained throughout the reaction. The lime green colored liquid was heated to 112° C. and the resultant transparent yellow liquid was allowed to reflux. 53.92 grams of 37% aqueous formaldehyde (0.66 mole) solution were added dropwise over a 43 minute (2580 s) period giving a yellow green colored liquid. The reactor contents were cooled to 18° C. with an ice bath and 38.30 grams of 37% concentrated hydrochloric acid (0.39 mole) were added dropwise over 14 minute (840 s) period. The resultant reactor contents were refluxed between 96°-101° C. for 251 minutes (15,060 s). A Barrett trap was installed to removed water, and the reactants were heated an additional 78 minutes (4680 s) between 101°-199° C. On cooling to room temperature, the reactor contents were a beige solid that was soluble in ethanol. The beige solid was dissolved in ethanol for the corrosion inhibition tests.

The following examples illustrate that base and other acid catalyst can be substituted for hydrochloric acid and the use of such catalysts is not required.

EXAMPLE 24

67.84 grams of KEMAMINE TM P-650 (0.33 mole) and 20.31 grams of 2,4,6-collidine (0.17 mole) were weighed into a reactor of the type described in Example 6. A nitrogen atmosphere was maintained throughout the reaction. After the reactants were heated to 101° C., 54.49 grams of 37% aqueous formaldehyde (0.67 mole) solution were added dropwise over 52 minute (3120 s) period giving a pale yellow-green liquid. After the reactants were heated for 317 minutes (19,020 s) between 104°-110° C., a Barret trap was installed to remove water. The reaction contents were heated an additional 37 minutes (2220 s) between 105°-188° C. After cooling to room temperature, the reactor contents were a reddish brown colored liquid that were soluble in xylene.

EXAMPLE 25

81.0 grams of KEMAMINE TM P-999 (0.31 mole), 18.38 grams of 2,4,6-collidine (0.15 mole) and 12.37 grams sodium hydroxide (0.31 mole) were weighed into a reactor of the type described in Example 6. KEMAMINE TM P-999 is a mixture of $C_{16}$-$C_{18}$ primary amines commercially available from Witco which consist primarily of 1-hexadecanamine, 1-octadecanamine, 9-octadecen-1-amine, 9,12-octadecadien-1-amine, 9,12,15-octadecatrien-1-amine, and 9-eicosen-1-amine. A nitrogen atmosphere was maintained throughout the reaction. After the reactants were heated to 116° C., 29.13 grams n-butanol was added to the reactor contents. Then 49.47 grams of 37% aqueous formaldehyde (0.61 mole) solution were added dropwise over 27 minute (1620 s) period giving a reddish brown colored liquid. After the reactants were heated for 273 minutes (16,380 s) between 93°-95° C., a Barrett trap was installed to remove water. The reaction contents were heated an additional 142 minutes (8520 s) between 99°-206° C. After cooling to room temperature, the reactor contents were a brown liquid that were soluble in xylene.

EXAMPLE 26

107.48 grams of KEMAMINE TM P-650 (0.53 mole) were weighed into a reactor of the type described in Example 6. A nitrogen atmosphere was maintained throughout the reaction. 24.30 grams of concentrated sulfuric acid (0.24 mole) were added over 15 minute (900 s) period to the cooled (5° C:) and stirred fatty alkyl amines. After 31.23 grams of 2,4,6-collidine (0.25 mole) were added to the reactor contents, they were heated to 115° C. and allowed to reflux. Then 41.50 grams of 37% aqueous formaldehyde (0.51 mole) solution were added dropwise over 110 minutes (6600 s). After a Barrett trap was installed to remove water, the reactor contents were heated an additional 360 minutes (21,600 s) between 100°-140° C. After cooling to room temperature, the reactor contents were a light yellow waxy solid that was soluble in acetic acid. 96.98 grams of the waxy solid were neutralized with 100 milliliters of an aqueous solution of 50% sodium hydroxide at 90° C. The light brown organic layer was separated from the aqueous layer with a separatory funnel. The dark brown liquid was subjected to rotary evaporation under full vacuum at 100° C.

EXAMPLE 27

84.34 grams of KEMAMINE TM P-650 (0.41 mole), 25.67 grams of 2,4,6-collidine (0.21 mole), 30 grams n-butanol, and 5.63 grams of zinc chloride (0.04 mole) were weighed into a reactor of the type described in Example 6. A nitrogen atmosphere was maintained throughout the reaction. After the reactants were heated to 110° C., 68.03 grams of 37% aqueous formaldehyde (0.84 mole) solution were added dropwise over 51 minutes (3060 s) period giving a pale yellow colored liquid. After the reactants were heated for 332 minutes (19,920 s) between 93°-95° C., a Barrett trap was installed for removal of water. The reaction contents were heated an additional 106 minutes (6360 s) between 95°-208° C. After cooling to room temperature, the reactor contents were a dark reddish brown colored liquid that were soluble in xylene and ethanol.

EXAMPLE 28

51.69 grams of KEMAMINE TM P-650 (0.25 mole), 15.57 grams of 2,4,6-collidine (0.13 mole) and 72.96 grams n-butanol were weighed into a reactor of the type described in Example 6. A nitrogen atmosphere was maintained throughout the reaction. 18.78 grams of glacial acetic acid (0.31 mole) were added to the stirred and cooled reactor contents over a 16 minute (960 s) period giving a pale yellow liquid. After the reactor contents were heated to 114° C., 41.86 grams of 37% aqueous formaldehyde (0.52 mole) solution were added dropwise over a 30 minute (1800 s) period giving an orange colored liquid. After the reactor contents were heated 745 minutes (44,700 s) between 95°-117° C., a Barrett trap was installed to remove water and n-butanol. Then the reactor contents were heated an additional 42 minutes (2520 s) between 104°-200° C. After cooling to room temperature, the reactor contents were a dark red wine colored liquid that was soluble in xylene. 24.68 grams of the dark red wine colored liquid was weighed onto an aqueous solution of 51% sodium hydroxide (193 grams) and stirred for 40 minutes (2400 s). After the stirring, the red wine colored liquid layered on top of the aqueous solution of sodium hydroxide. The red wine colored liquid was separated from the aqueous solution of sodium hydroxide with a separatory funnel. The red wine colored liquid was subjected to rotary evaporation under full vacuum at 100° C.

EXAMPLE 29

This example demonstrates the corrosion protection of Examples 1 through 28 by the 79.4° C. (175° F.) batch wheel test procedure. The results are given in Table I.

TABLE I

| TEST NO. | INHIBITOR TYPE | INHIBITOR CONCENTRATION | WEIGHT LOSS (g) | MPY* | PERCENT PROTECTION |
|---|---|---|---|---|---|
| A-1 | None | 0 | 0.2049 | 82.8 | 0 |
| A-2 | Ex. 1 | 100 ppm | 0.0041 | 1.6 | 98.0 |
| A-3 | Ex. 2 | 100 ppm | 0.0040 | 1.6 | 98.1 |
| B-1 | None | 0 | 0.1665 | 63.1 | 0 |
| B-2 | Ex. 2 | 3 ppm | 0.0342 | 12.9 | 79.5 |
| B-3 | Ex. 2 | 5 ppm | 0.0151 | 5.7 | 90.9 |
| B-4 | Ex. 2 | 10 ppm | 0.0050 | 1.9 | 97.0 |
| C-1 | None | 0 | 0.1683 | 68.5 | 0 |
| C-2 | Ex. 3 | 100 ppm | 0.0044 | 1.8 | 97.4 |
| C-3 | Ex. 4 | 100 ppm | 0.0062 | 2.5 | 96.3 |
| D-1 | None | 0 | 0.1938 | 74.2 | 0 |
| D-2 | Ex. 5 | 100 ppm | 0.0059 | 2.3 | 97 |
| E-1 | None | 0 | 0.2294 | 87.2 | 0 |
| E-2 | Ex. 6 | 100 ppm | 0.0025 | 0.9 | 98.9 |
| F-1 | None | 0 | 0.2630 | 99.8 | 0 |
| F-2 | Ex. 7 | 100 ppm | 0.0024 | 0.9 | 99.1 |
| G-1 | None | 0 | 0.2294 | 87.2 | 0 |
| G-2 | Ex. 8 | 100 ppm | 0.0043 | 1.6 | 98.1 |
| H-1 | None | 0 | 0.1749 | 65.7 | 0 |
| H-2 | Ex. 9 | 100 ppm | 0.0054 | 2.0 | 96.9 |
| I-1 | None | 0 | 0.2215 | 84.1 | 0 |
| I-2 | Ex. 10 | 100 ppm | 0.0048 | 1.8 | 97.8 |
| I-3 | Ex. 11 | 100 ppm | 0.0047 | 1.7 | 97.9 |
| I-4 | Ex. 13 | 100 ppm | 0.0062 | 2.4 | 97.2 |
| 1-5 | Ex. 14 | 100 ppm | 0.0093 | 3.6 | 95.8 |
| J-1 | None | 0 | 0.2380 | 90.6 | 0 |
| J-2 | Ex. 12 | 100 ppm | 0.0050 | 1.9 | 97.9 |
| K-1 | None | 0 | 0.2630 | 99.8 | 0 |
| K-2 | Ex. 15 | 100 ppm | 0.0085 | 3.2 | 96.8 |
| L-1 | None | 0 | 0.1886 | 71.4 | 0 |
| L-2 | Ex. 16 | 100 ppm | 0.0040 | 1.5 | 97.9 |
| L-3 | Ex. 17 | 100 ppm | 0.0032 | 1.2 | 98.3 |
| M-1 | None | 0 | 0.1940 | 72.5 | 0 |
| M-2 | Ex. 18 | 100 ppm | 0.0030 | 1.1 | 98.4 |
| N-1 | None | 0 | 0.1693 | 63.8 | 0 |
| N-2 | Ex. 19 | 100 ppm | 0.0466 | 17.7 | 72.5 |
| O-1 | None | 0 | 0.1671 | 64.0 | 0 |
| O-2 | Ex. 20 | 100 ppm | 0.0144 | 5.5 | 91.4 |
| P-1 | None | 0 | 0.1940 | 72.5 | 0 |
| P-2 | Ex. 21 | 100 ppm | 0.0031 | 1.2 | 98.4 |
| Q-1 | None | 0 | 0.1834 | 70.4 | 0 |
| Q-2 | Ex. 22 | 100 ppm | 0.0055 | 2.1 | 97.0 |
| R-1 | None | 0 | 0.1940 | 72.5 | 0 |
| R-2 | Ex. 23 | 100 ppm | 0.0036 | 1.4 | 98.1 |
| S-1 | None | 0 | 0.2242 | 85.5 | 0 |
| S-2 | Ex. 24 | 100 ppm | 0.0117 | 4.5 | 94.8 |
| T-1 | None | 0 | 0.3246 | 122.9 | 0 |
| T-2 | Ex. 25 | 100 ppm | 0.0591 | 22.5 | 81.8 |
| U-1 | None | 0 | 0.1819 | 70.1 | 0 |
| U-2 | Ex. 26 | 100 ppm | 0.0087 | 3.2 | 95.2 |
| V-1 | None | 0 | 0.2242 | 85.5 | 0 |
| V-2 | Ex. 27 | 100 ppm | 0.0063 | 2.4 | 97.2 |
| W-1 | None | 0 | 0.3246 | 122.9 | 0 |
| W-2 | Ex. 28 | 100 ppm | 0.0070 | 2.7 | 97.8 |
| X-1 | None | 0 | 0.3328 | 131.0 | 0 |
| X-2 | CORBAN A-163** | 100 ppm | 0.0658 | 26.0 | 80.2 |

*MPY is mils per year.
**CORBAN A-163 is a commercial corrosion inhibitor available from Dowell-Schlumberger.

The data in Table I demonstrates that 3 to 100 ppm of the inhibitors of this invention exhibit good corrosion protection under simulated down hole tests at 79.4° C.

Corrosion protection is significantly better than that exhibited by commercially available CORBAN A-163 (Test No. X-2). Therefore, the corrosion inhibitors of this invention are suitable for the protection of metal alloys against corrosion due to corrosive fluids produced in oil and gas well formations and harmful to said metal alloys at or below 79.4° C. In addition, the corrosion inhibitors of this invention are suitable for the corrosion protection of pipelines, storage tanks, pumps, etc., that exist for the purpose of separating, recovering, oil and/or gas from the produced fluids.

EXAMPLE 30

The following example demonstrates the performance of the inhibitors of this invention in a 350° F. (177° C.) wheel test. The concentrations and results are given in Table II.

TABLE II

| TEST NO. | INHIBITOR TYPE | INHIBITOR CONCENTRATION | WEIGHT LOSS (g) | PERCENT PROTECTION |
|---|---|---|---|---|
| A-1 | None | 0 | 0.1082 | 0 |
| A-2 | C-4[1] | 100 ppm | 0.0246 | 77 |
| A-3 | C-5[2] | 100 ppm | 0.0485 | 55 |
| B-1 | None | 0 | 0.1192 | 0 |
| B-2 | Ex. 2 | 100 ppm | 0.0146 | 89 |
| B-3 | Ex. 3 | 100 ppm | 0.0253 | 80 |
| C-1 | None | 0 | 0.1358 | 0 |
| C-2 | Ex. 5 | 100 ppm | 0.0217 | 85 |
| D-1 | None | 0 | 0.1197 | 0 |
| D-2 | Ex. 6 | 100 ppm | 0.0237 | 81 |
| D-3 | Ex. 10 | 100 ppm | 0.0237 | 81 |

[1]C-4 is a commercial corrosion inhibitor available from Dowell-Schlumberger as CORBAN A-163.
[2]C-5 is a commercial corrosion inhibitor available from Henkel as TEXAMINE T5D.

Thus, the inhibitors of this invention advantageously provide good corrosion protection at 350° F., demonstrating the value of these inhibitors for high temperature oil and gas well environments. This corrosion inhibition is surprisingly high when compared to commercially available corrosion inhibitors (Test Nos. A-2 and A-3).

EXAMPLE 31

The brine and hydrocarbon solubility of the inhibitor of Example 2 was evaluated by using the 79.4° C. (175° F.) batch wheel test procedure with 90% brine/10% kerosene, 50% brine/50% kerosene and 10% brine/90% kerosene. This test demonstrates that the inhibitor of Example 2 maintains corrosion protection in both brine and hydrocarbon. The test was conducted using 100 ppm of inhibitor.

The results are given in Table III.

TABLE III

| | NO INHIBITOR | EXAMPLE 2 (2,5-DIMETHYLPYRAZINE/$CH_2O$/P-650) |
|---|---|---|
| % PROTECTION IN 90% BRINE/10% KEROSENE | 0 | 98.1 |
| MPY* IN 90% BRINE 10% KEROSENE | 82.8 | 1.6 |
| % PROTECTION IN 50% BRINE/50% KEROSENE | 0 | 87.9 |
| MPY* IN 50% BRINE 50% KEROSENE | 27.6 | 3.3 |
| % PROTECTION IN 10% BRINE/90% KEROSENE | 0 | 90.5 |
| MPY* IN 10% BRINE 90% KEROSENE | 21.3 | 2 |

*MPY = mils per year

We claim:

1. A process for preventing the corrosion of a metal composition in contact with a down hole well fluid, which process comprises contacting the surface of said metal composition with an effective amount of, as a corrosion inhibitor, the product resulting from reacting at a temperature of from about 25° C. to about 250° C. for a time sufficient to complete the reaction of (A) at least one aromatic heterocyclic material having one or more rings, at least one nitrogen atom located in the heterocyclic ring and at least one substituent group which has at least one reactive hydrogen atom attached to a carbon atom which is attached to a carbon atom in the aromatic heterocyclic ring selected from the group consisting of heterocyclic compounds represented by the following formulas

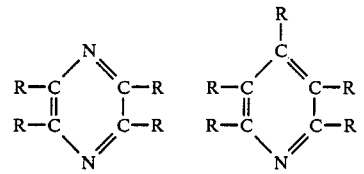

PYRAZINES PYRIDINES

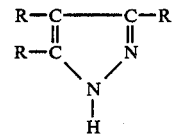

PYRAZOLES

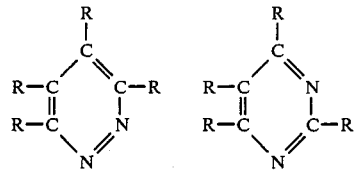

PYRIDAZINES PYRIMIDINES

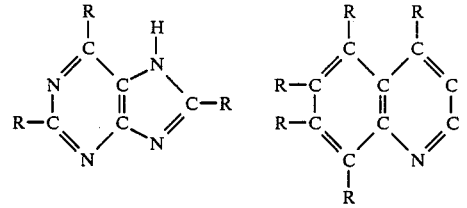

PURINES QUINOLINES

-continued

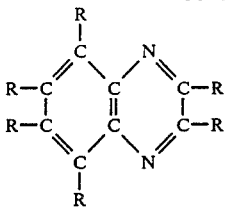

QUINOXALINES

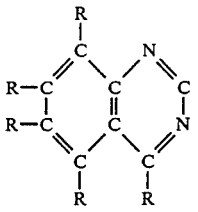

QUINAZOLINES

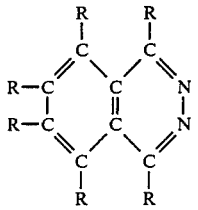

PHTHALAZINES wherein each R is independently hydrogen or a hydrocarbyl group at least one of such R groups being one which has at least one reactive hydrogen atom attached to a carbon atom which is attached to a carbon atom in the aromatic heterocyclic ring;

(B) at least one aldehyde, ketone or combination thereof; and (C) (1) at least one monoamine having a combined total of at least seven carbon, nitrogen, oxygen or sulfur atoms and at least one reactive amine hydrogen atom; (2) at least one polyamine; or (3) a mixture of (1) and (2); and wherein the components are employed in quantities which provide a mole ratio of (A):(B):(C) of from about 1:0.25:0.25 to about 1:5:5.

2. A process of claim 1 wherein said effective amount of corrosion inhibitor ranges from about 1 to about 2,000 ppm, based on the weight of said well fluid in contact with said metal composition.

3. A process of claim 2 wherein said corrosion inhibitor is contacted with a carrier liquid and subsequently contacted with said well fluid.

4. A process of claim 1 wherein component (A) is a pyridine, pyrazine, quinoline, pyridazine, pyrimidine, quinoxaline or a mixture thereof; component (B) is formaldehyde or acetone and component (C) is an aliphatic primary monoamine having a combined total of from about 10 to about 20 carbon, nitrogen, oxygen or sulfur atoms, a polyamine or a mixture of the aliphatic primary monoamine with a polyamine.

5. A process of claim 4 wherein said effective amount of corrosion inhibitor ranges from about 1 to about 2,000 ppm, based on the weight of said well fluid in contact with said metal composition.

6. A process of claim 5 wherein said corrosion inhibitor is contacted with a carrier liquid and subsequently contacted with said well fluid.

7. A process of claim 4 wherein component (A) is 2,5-dimethylpyrazine, 2,4,6-trimethylpyridine, 2,6-dimethylquinoline, 4,6-dimethylpyrimidine, 2,3-dimethylquinoxaline, 5-ethyl-2-methylpyridine, 3-ethyl-2,6-dimethylpyridine, 3-ethyl-2,5-dimethylpyrazine, 2-methylpyridine, 2,6-dimethylpyridine, 2,3-dimethylpyridine, 2,3,6-trimethylpyridine, 3-ethyl-4-methylpyridine, 2,3,5-trimethylpyridine, 2-ethyl-4,6-dimethylpyridine, or mixture thereof; and component (C) is 1-hexadecanamine, 1-octadecanamine, 9-octadecen-1-amine, 9,12-octadecadien-1-amine, 9,12,15-octadecatrien-1-amine, 9-eicosen-1-amine, 1-decanamine, 1-undecanamine, 1-dodecanamine, 1-tridecanamine, 1-tetradecanamine, 1-pentadecanamine, 1-hexadecanamine, 1-heptadecanamine, 1-octadecanamine, tetraethylenepentamine, pentaethylenehexamine, hexaethyleneheptamine, or a combination thereof.

8. A process of claim 7 wherein said effective amount of corrosion inhibitor ranges from about 1 to about 2,000 ppm, based on the weight of said well fluid in contact with said metal composition.

9. A process of claim 8 wherein said corrosion inhibitor is contacted with a carrier liquid and subsequently contacted with said well fluid.

10. A process of claim 4 wherein component (A) is 2,5-dimethylpyrazine, 2,4,6-trimethylpyridine, 2,6-dimethylquinoline, 4,6-dimethylpyrimidine, 2,3-dimethylquinoxaline, 5-ethyl-2-methylpyridine, 3-ethyl-2,6-dimethylpyridine, 3-ethyl-2,5-dimethylpyrazine, 2-methylpyridine, 2,6-dimethylpyridine, 2,3-dimethylpyridine, 2,3,6-trimethylpyridine, 3-ethyl-4-methylpyridine, 2,3,5-trimethylpyridine, 2-ethyl-4,6-dimethylpyridine, or mixture thereof; and component (C) is a mixture comprising at least one of 1-hexadecanamine, 1-octadecanamine, 9-octadecen-1-amine, 9,12-octadecadien-1-amine, 9,12,15-octadecatrien-1-amine, 9-eicosen-1-amine, 1-decanamine, 1-undecanamine, 1-dodecanamine, 1-tridecanamine, 1-tetradecanamine, 1-pentadecanamine, 1-hexadecanamine, 1-heptadecanamine, 1-octadecanamine, and at least one of 1,2-ethanediamine, N-(2-aminoethyl)-1,2-ethanediamine, triethylenetetramine, tetraethylenepentamine, pentaethylenehexamine or hexaethyleneheptamine.

11. A process of claim 10 wherein said effective amount of corrosion inhibitor ranges from about 1 to about 2,000 ppm, based on the weight of said well fluid in contact with said metal composition.

12. A process of claim 11 wherein said corrosion inhibitor is contacted with a carrier liquid and subsequently contacted with said well fluid.

13. A process of claim 1 wherein said corrosion inhibitor is in the free amine or the hydrochloride form.

14. A process of claim 13 wherein said effective amount of corrosion inhibitor ranges from about 1 to about 2,000 ppm, based on the weight of said well fluid in contact with said metal composition.

15. A process of claim 14 wherein said corrosion inhibitor is contacted with a carrier liquid and subsequently contacted with said well fluid.

16. A process of claim 4 wherein said corrosion inhibitor is in the free amine or the hydrochloride form.

17. A process of claim 16 wherein said effective amount of corrosion inhibitor ranges from about 1 to about 2,000 ppm, based on the weight of said well fluid in contact with said metal composition.

18. A process of claim 17 wherein said corrosion inhibitor is contacted with a carrier liquid and subsequently contacted with said well fluid.

19. A process of claim 7 wherein said corrosion inhibitor is in the free amine or the hydrochloride form.

20. A process of claim 19 wherein said effective amount of corrosion inhibitor ranges from about 1 to about 2,000 ppm, based on the weight of said well fluid in contact with said metal composition.

21. A process of claim 20 wherein said corrosion inhibitor is contacted with a carrier liquid and subsequently contacted with said well fluid.

22. A process of claim 10 wherein said corrosion inhibitor is in the free amine or the hydrochloride form.

23. A process of claim 22 wherein said effective amount of corrosion inhibitor ranges from about 1 to about 2,000 ppm, based on the weight of said well fluid in contact with said metal composition.

24. A process of claim 23 wherein said corrosion inhibitor is contacted with a carrier liquid and subsequently contacted with said well fluid.

* * * * *